US005984738A

United States Patent [19]

Michelmann et al.

[11] Patent Number: 5,984,738

[45] Date of Patent: Nov. 16, 1999

[54] CONTACTING CLIP

[75] Inventors: Folke Michelmann, Neuhausen; Peter Kuhn, Kongen, both of Germany

[73] Assignee: Richard Hirschmann GmbH & Co., Neckartenzlingen, Germany

[21] Appl. No.: 09/065,035

[22] PCT Filed: Aug. 13, 1996

[86] PCT No.: PCT/EP96/03574

§ 371 Date: Apr. 27, 1998

§ 102(e) Date: Apr. 27, 1998

[87] PCT Pub. No.: WO97/15963

PCT Pub. Date: May 1, 1997

[30] Foreign Application Priority Data

Oct. 26, 1995 [DE] Germany ..... 195 39 931

[51] Int. Cl.[6] ..... H01R 4/48

[52] U.S. Cl. ..... 439/786; 439/789

[58] Field of Search ..... 439/786, 789, 439/835, 834, 828, 829

[56] References Cited

U.S. PATENT DOCUMENTS

| | | | |
|---|---|---|---|
| 3,838,203 | 9/1974 | Brandlein | 174/68.5 |
| 4,708,417 | 11/1987 | Woertz | 439/828 |
| 5,441,421 | 8/1995 | Ponticelli | 439/789 |

FOREIGN PATENT DOCUMENTS

| | | |
|---|---|---|
| 218133 | 4/1987 | European Pat. Off. . |
| 2524721 | 10/1983 | France . |
| 1105937 | 5/1961 | Germany . |
| 1196741 | 7/1965 | Germany . |
| 2800307 | 7/1978 | Germany . |
| 3818548 | 12/1989 | Germany . |
| 4233446 | 10/1993 | Germany . |

*Primary Examiner*—Neil Abrams
*Assistant Examiner*—Javaid Nasri
*Attorney, Agent, or Firm*—Fulbright & Jaworski, L.L.P.

[57] ABSTRACT

A clamp contact device for providing mechanical and electrical attachment for cables, wires, and electrical conductors. A single device can provide simultaneous dual attachment modes for cables, wires, and plugs. One end of the device contains two holes on separate spring legs. The spring legs can be pressed towards each other until the holes are in alignment. By inserting the cable through the aligned holes and releasing the legs, spring tension in the legs tries to force the holes apart, clamping the cable in place. The other end of the device has an opening for insertion of an pin, plug, or similar element. A fork spring that partially extends into the interior of the device provides spring-loaded extensions that contact an inserted plug and hold it in place, without the need to initially press on any part of the device. The device can be manufactured from a single piece of sheet metal. Another embodiment includes a separate spring within the interior of the device, which provides spring tension for the legs, allowing the legs to be made of materials that have good electrical conductivity rather than good spring qualities. This second spring can also serve as a stop to prevent inserted wires from protruding beyond a certain point. This assures that a wire inserted from one end will not interfere with a plug inserted from the other end.

16 Claims, 2 Drawing Sheets

CONTACTING CLIP

FIELD OF THE INVENTION

The invention relates to a clamp contact means as claimed in the preamble of claim 1.

BACKGROUND OF THE TECHNOLOGY

Clamp contact devices are known from EP-A-0 218 133, FR-A-2 524 721, and DE-B-11 96 741. In all these spring clamps, which are built and operate according to the same principle, clamp contacting adequate for the stated purposes is achieved. However, these clamp devices do not provide for an electrical connection with a plug-in contact element.

DE 28 00 307 A1 discloses a contact point with a movable spring leg which rests on a printed circuit board and which runs at an angle thereto and a fork spring located on the outside of the deflectable spring leg. This contact point is suitable for electrical connection to a plug pin, but not for clamp contacting of a cable. But primarily this component has very large dimensions which make it essentially useless for many applications due to the spring leg which rests on the board and which is pulled forward in the plug-in direction, and especially due to the fork spring provided on the outside of the movable spring leg.

Furthermore, DE 42 33 446 C1 discloses a clamp contact device as is shown schematically in FIGS. 5 and 6, FIG. 5 showing the clamp contact means in the closed, or clamped, state, and FIG. 6 shows the clamp contact device in the open state, in which the cable can be inserted in the clamp contact device. In this known clamp contact device in plastic housing 1 there is clamp contact spring 2 which is riveted or caulked to support body 3 likewise located in plastic housing 1. Clamp contact spring 2 has fixed spring leg 4 and deflectable spring leg 5, and the latter can be pressed inward towards fixed spring leg 4 by means of lever 6 against spring force (compare FIG. 6). A cable (which is not shown), or the stripped conductor of a cable, can be pushed through opening 7 in plastic housing 1 into the latter and between deflectable spring leg 5 and stop 8 of support body 3. When lever 6 is released the inserted cable or inserted cable conductor is pressed against stop 8 by the spring force of deflectable spring leg 5 and in this way electrical contact is established between the cable and clamp contact means or support body 3. At the same time deflectable spring leg 5 mechanically fixes the cable or cable conductor, one free edge 9 of deflectable spring leg 5 acting as the contact blade.

This clamp contact means is complex, both with respect to production and also mounting. To achieve sufficient spring action contact spring 2 must be produced from spring steel so that additional support body 3 of bronze or brass is necessary to ensure adequate contacting and low electrical resistance. To deflect spring leg 5, i.e. to open or close the clamp contact device, additional lever 6 is necessary. To open the clamp contact device a tool is necessary, for example a screwdriver, which increases the operating effort of the user. In addition, the clamp must be mounted securely on a circuit board or a housing since for actuating the clamp both hands are necessary, one for holding the cable and the other for holding the tool, so that the hands are no longer free to hold the clamp itself. Another important disadvantage of this known clamp contact device is that it can be miniaturized only with high cost.

SUMMARY OF THE INVENTION

An object of this invention is to devise a clamp contact device which can be produced as a very small unit and which easily and economically enables plug-in element contacting.

Based on a fork spring provided for making contact with a plug-in contact element, the clamp contact device can be used in a very wide range of applications, specifically also for the large domain of cable connectors. Here the function of the clamp contact spring for clamping and contacting of a cable is in no way adversely affected, because it need be inserted only slightly through the clamp area of the two holes into the interior between the spring arms to ensure good clamping, contacting and protection against pullout. The entire remaining interior between the spring legs can be used for the arrangement of the fork spring.

The arrangement of the fork spring between the spring legs results in extremely small dimensions of the clamp contact device, an advantage which satisfies a basic requirement among connectors and makes the clamp contact device especially suitable for multipin connectors as well.

Preferably fork spring legs project from the side edges of at least one of the end areas of the spring legs of the clamp contact spring and are bent in the area between the spring, legs of the clamp contact spring. On the part of the spring contact opposite the end area of the spring legs of the clamp contact spring, there is a recess for passage of the plug-in contact element. In this way it is possible to produce the clamp contact device with much smaller dimensions than conventional devices of this type without the need to tolerate disadvantages with regard to spring action. This is achieved by the connection parts for the stripped cable and the fork spring or fork contact for the plug contact element being folded into one another in a very narrow space, so that the contact spring lengths increase and a sufficient spring path is achieved without requiring larger dimensions.

Very simple and economical production of the clamp contact device is preferably achieved by the clamp contact springs being made with the spring legs, end areas, legs of the fork spring and/or soldering lugs from a metal plate or metal sheet, preferably of brass or bronze, in one piece. This makes it possible to produce, in one production pass, both the holes and the profile of the spring arms for insertion into the corresponding recesses of a clamp strip and also the recess for passage of the plug-in contact element in one working pass and accordingly to bend or fold the parts of the punched-out or cut-out metal plate into the stipulated position.

According to one especially advantageous embodiment of the invention there is an additional spring. It improves the mechanical properties of the clamp contact spring, specifically its contact force or the pull-out force of the cable or contacted cable conductor.

When the clamp contact spring is produced from brass or bronze for reasons of good electrical contact, the additional spring is especially advantageous because the spring action of a clamp contact spring consisting of these materials may not be adequate. Since the additional spring creates no electrical contacting, it can consist advantageously of steel.

Preferably the additional spring is located between the spring legs of the clamp contact spring, it being especially advantageous if the ends of the spring sheet or spring wire are supported on the spring legs of the clamp contact spring.

The additional spring between the spring legs of the clamp contact spring is preferably shaped such that it limits the penetration depth of the cable or cable conductors into the contact spring area. The additional spring is used in this embodiment as a stop for the inserted cable, so that the cable does not penetrate into the plug space. In this way, without additional costs it becomes possible for the plug-in contact elements, for example, brass contacts of an appliance connector, to be inserted without hindrance into the fork springs, for the dimensions of the clamp contact device to be small in the plug-in direction as well, and for special devices not to be necessary for insertion of the cable ends by the same amount.

On one of the spring legs, especially on the one which is not deflected, there is preferably a soldering lug to which electrical components such as light emitting diodes, resistors, etc. can be attached or soldered. The soldering lug is preferably made as an angled part of the end area of the spring leg, and has a hole or recess.

Preferably the clamp contact spring is located in a housing which has an open area for exerting pressure, for example by means of a finger, on a spring leg. For the case in which it is necessary because of force or construction configuration, a lever element for exerting pressure can be provided.

In one advantageous embodiment the clamp contact spring is attached on clamp strip. Preferably the clamp contact spring can be inserted into matched recesses of the clamp strip. For holding several contact springs in a clamp strip, the recesses can be arranged to save as much space as possible and can be open on the side on which is located the spring leg of the clamp contact spring on which pressure is exerted by the finger for opening and closing the spring contact.

According to one advantageous embodiment of the clamp contact spring or the clamp strip, a spring leg of the clamp contact spring can be inserted into complementary grooves of the clamp strip. The side areas of one of the spring legs, preferably the one on which no pressure is exerted by the finger, are inserted into the corresponding grooves of the clamp strip, and held there without additional attachment requirements. The installation of the clamp strip or the contact springs attached therein is therefore very simple. In addition the replacement of defective clamp contact springs is easily possible.

BRIEF DESCRIPTION OF THE DRAWINGS

FIG. 1 shows the clamp contact device in the closed state without a cable clamped in.

FIG. 3 shows the clamp contact device with the cable clamped in.

DETAILED DESCRIPTION OF THE INVENTION

Figure 1:
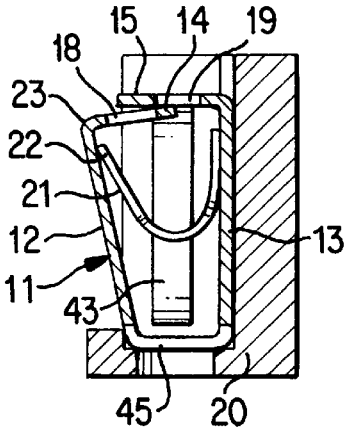

The embodiment of a clamp contact device shown in FIGS. 1 to 4 has clamp contact spring 11 with two spring legs 12, 13 which end in two spring leg end areas 14, 15 which are bent towards the intermediate space between spring legs 12, 13 such that they lie in a row with one another in their position which clamps one conductor 16 of cable 17. Spring leg end areas 14, 15 have holes 18 or 19 for passage of cable 17.

In the embodiment shown, clamp contact spring 11 is located in plastic housing 20. However, one side of housing 20 remains free so that spring leg 12 of clamp contact spring 11 can be reached with the hand or one finger. Clamp contact spring 11 may be made of brass or bronze.

Between spring legs 12, 13 of clamp contact spring 11 is an additional spring 21 consisting of spring steel. This additional spring 21 in the embodiment shown is fixed on the inside of spring leg 13 which adjoins housing 20, while free end 22 of additional spring 21 in the upper area in front of bending point 23 of spring leg 12 adjoins its inside and thus increases the spring force of clamp contact spring 11.

Figure 2:
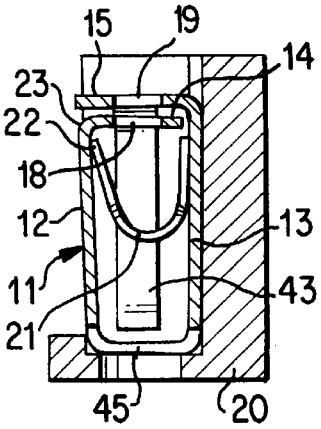
FIG. 2 shows the clamp contact device in a state in which the cable can be inserted.
Figure 3:
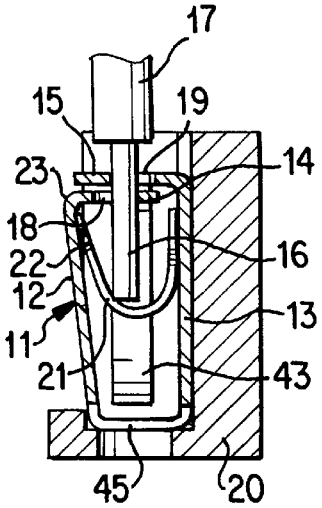
Figure 5:
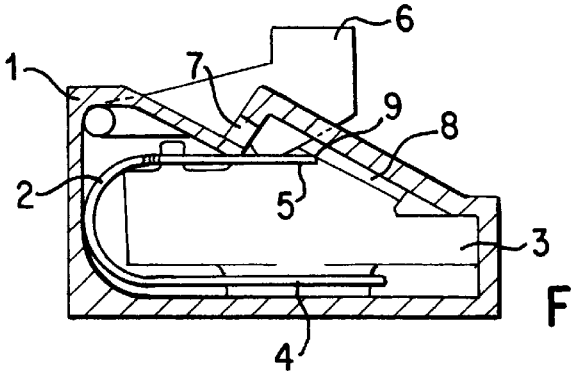
FIG. 5 PRIOR ART
FIG. 5 shows a schematic for a previously known clamp contact device with a closed clamp contact spring.
Figure 6:
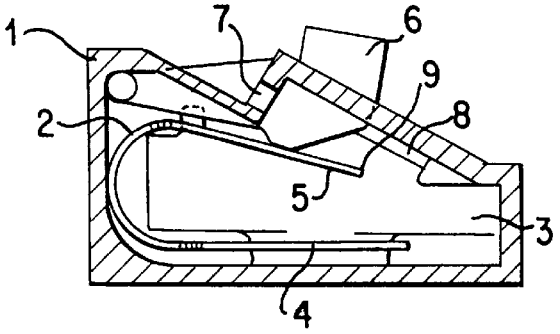
FIG. 6 PRIOR ART
FIG. 6 shows the clamp contact device of FIG. 5 with an open clamp contact spring.

In FIG. 1 contact spring 11 in the uninfluenced state is in a position in which spring legs 12, 13 are spaced farthest apart from one another. If at this point contacting of cable 17 or its stripped conductor 16 should take place, spring leg 12 which is not supported on housing 20 is pressed with the finger towards spring leg 13 supported on housing 20 against the spring force both of contact spring 11 and also additional spring 21 until two holes 18, 19 of spring leg end areas 14, 15 are superimposed on one another. The length of spring leg end area 14 is chosen such that when it meets the spring leg end area edge this takes place on opposite spring leg 13 which is supported on housing 20. In this state which is shown in FIG. 2 it is now possible to insert stripped conductor 16 of cable 17 through two holes 18, 19 of spring leg end areas 14, 15 at most until conductor 16 meets additional spring 21, as is apparent from FIG. 3. If at this point the hand or finger pressure on the spring leg which is not supported on housing 20 is reduced, holes 18, 19 of spring leg end areas 14, 15 are offset from one another so that between them they clamp conductor 16 and both hold it mechanically and also produce the conductive connection to clamp contact spring 11.

Figure 4:
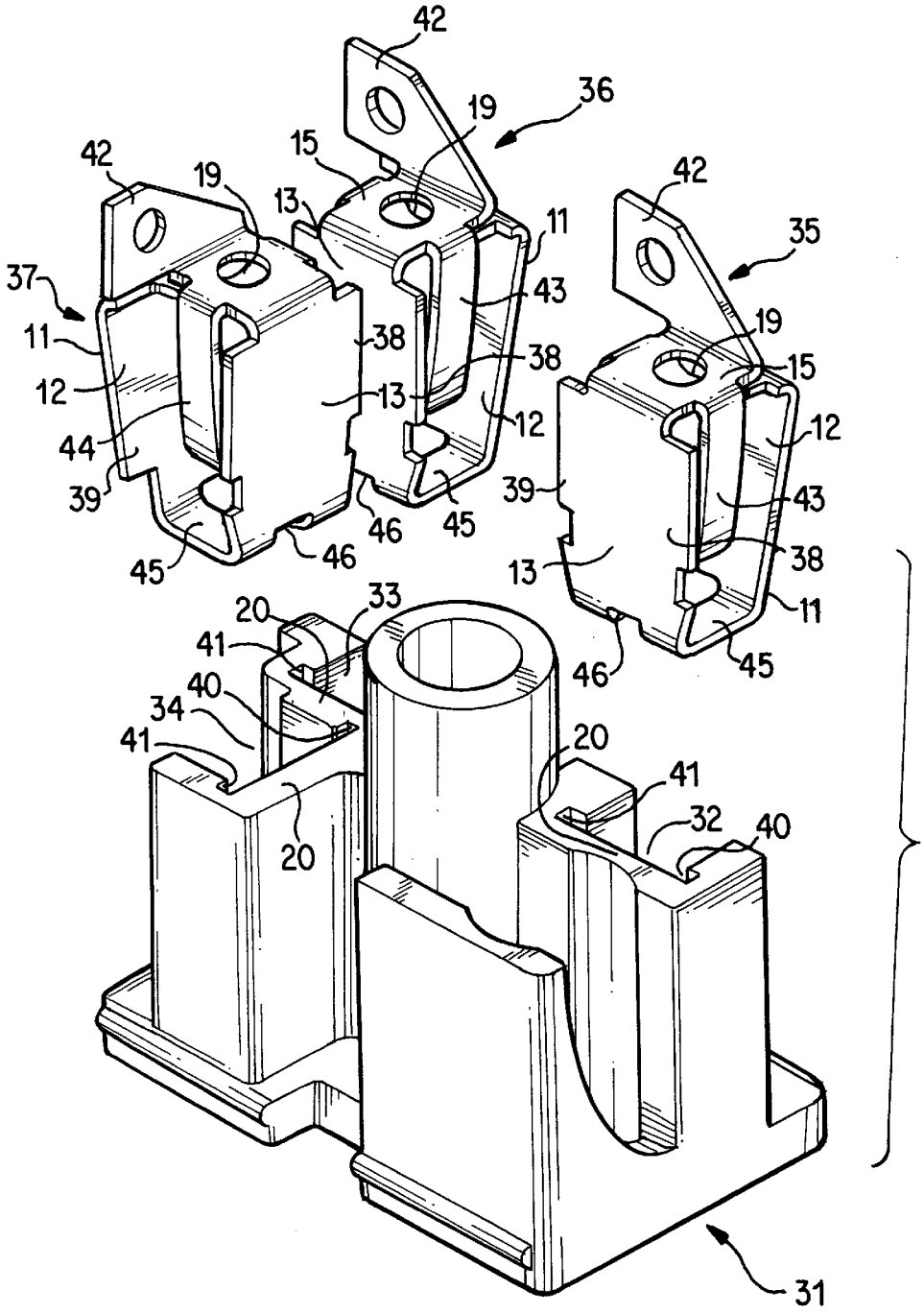
FIG. 4 shows a perspective representation of several clamp contact devices positioned for insertion into the housing.

FIG. 4 shows schematically and in perspective the embodiment of clamp strip 31 with three housing areas 32, 33, 34 for holding one clamp contact device 35, 36 and 37 each. Clamp contact device 35, 36, and 37 are shown outside of clamp strip 31, but in the position dictated by housing areas 32, 33, and 34.

In the embodiments shown, spring legs 13 which are supported on housing 20 have edge areas 38 and 39 which can be inserted into corresponding complementary grooves 40, 41 of housing areas 32, 33, and 34 and held therein. Installation is thus very simple and economical.

In the embodiments of the clamp contact device shown in FIG. 4 there are soldering lugs 42 for attaching or soldering an electronic part, for example a light emitting diode or a resistor.

As is best shown in FIG. 4, on the side edges of end areas 15 of spring leg 13, fork spring legs 43, 44 project and within clamp contact spring 11 form a contact area for a plug-in contact element (which is not shown), for example a plug pin or a plug blade. So that the plug-in contact element can be inserted into the fork spring consisting of fork spring legs 43, 44, in end 45 of clamp contact spring 11 opposite the end areas there is recess 46 through which the plug-in contact element is plugged between fork springs legs 43, 44 and contact is made.

Due to this folding of the contact area for the plug contact element into clamp contact spring 11, a very compact device which requires very little space is formed without the need for downstrokes on the spring action because the spring paths still remain sufficiently large.

The invention has been explained in terms of a preferred embodiment. However, to one skilled in the art numerous modifications and embodiments are possible without departing from the inventive idea. For example, it is possible to provide a lever element with which pressure can be exerted on one or both spring legs 12, 13. Furthermore, it is possible to exert pressure on both spring arms 12, 13 for relative displacement of holes 18, 19 to one another, by making housing 20 accordingly. These and other variations are encompassed by the invention, which is limited only by the scope and spirit of the appended claims.

What is claimed is:

1. A clamp contact device for clamping and making contact with a cable conductor or cable comprising: a first spring having two spring legs with end areas bent towards each other and able to move essentially parallel to one another, the end areas having alignable holes for insertion of a cable conductor or cable when the spring legs are pressed together against the spring force of the first spring, a spring motion of the end areas causing contacting and clamping of the cable conductor or cable in the holes, and wherein the clamp contact device has a fork spring disposed between the spring legs of said first spring and electrically and mechanically connected thereto for contacting a plug-in contact element.

2. The clamp contact device of claim 1, wherein:

said end areas include a side edge; and said fork spring projects from said side edge.

3. The clamp contact device of claim 2, wherein said first spring is a one-piece metal part including said spring legs, said end areas, and said fork spring.

4. The clamp contact device of claim 3, wherein said first spring further includes a soldering lug.

5. The clamp contact device of claim 1, further comprising a recess for passage of said plug-in contact element disposed opposite said end areas.

6. The clamp contact device of claim 1, wherein said first spring includes brass.

7. The clamp contact device of claim 1, wherein said first spring includes bronze.

8. The clamp contact device of claim 1, further comprising a second spring forcibly pressing said legs of said first spring apart.

9. The clamp contact device of claim 8, wherein said second spring is disposed between said legs of said first spring.

10. The clamp contact device of claim 8, wherein:

said second spring includes spring steel sheet; and said second spring includes spring ends supported by said legs of said first spring.

11. The clamp contact device of claim 8, wherein:

said first spring defines a first spring area; and said second spring is placed for limiting a penetration depth of said conductor into said first spring area.

12. The clamp contact device of claim 1, wherein said spring legs include a soldering lug.

13. The clamp contact device of claim 1, further comprising:

a housing with an open area for exerting pressure on one of said spring legs; and wherein said first spring is disposed in said housing.

14. The clamp contact device of claim 1, further comprising:

a clamp strip; and wherein said first spring is attached to said clamp strip.

15. The clamp contact device of claim 14, wherein:

said clamp strip includes matched recesses; and said first spring is insertable into said matched recesses.

16. The clamp contact device of claim 15, wherein:

said clamp strip includes complementary grooves; and at least one of said spring legs is insertable into said complementary grooves.

* * * * *